US005503486A

United States Patent [19]

Zane

[11] Patent Number: 5,503,486

[45] Date of Patent: Apr. 2, 1996

[54] NOTEBOOK AND NOTEBOOK COVER ASSEMBLY

[76] Inventor: Barry Zane, 2572 Piccadilly Cir., Thousand Oaks, Calif. 91362

[21] Appl. No.: 206,359

[22] Filed: Mar. 7, 1994

[51] Int. Cl.[6] ..... B42F 3/00; B42F 13/00; B42D 3/00

[52] U.S. Cl. ..... 402/72; 402/75; 402/76; 402/77; 402/80 R; 281/27.1; 281/28; 281/33; 281/35

[58] Field of Search ..... 402/70–72, 75, 402/73, 74, 76, 77, 78, 80 R, 80 P; 281/18, 27.1, 27.2, 27.3, 28, 33, 35, 36, 37, 40

[56] References Cited

U.S. PATENT DOCUMENTS

| | | | |
|---|---|---|---|
| 80,745 | 8/1868 | Jones et al. . | |
| 214,415 | 3/1879 | Lapham . | |
| 301,368 | 7/1884 | Hurly . | |
| 372,675 | 11/1887 | Herring . | |
| 554,417 | 2/1896 | Forsheim . | |
| 596,215 | 12/1897 | Moritz . | |
| 841,706 | 1/1907 | Morden . | |
| 880,053 | 2/1908 | Trussell | 402/80 R X |
| 1,129,891 | 3/1915 | Morden | 402/75 |
| 1,163,766 | 12/1915 | Morden | 402/80 R X |
| 1,534,735 | 4/1925 | Primbs, Sr. | 402/8 |
| 2,071,767 | 2/1937 | Schade | 402/76 X |
| 2,202,567 | 5/1940 | Spinner . | |
| 2,490,147 | 12/1949 | Minton | 402/80 R X |
| 3,039,472 | 6/1962 | Dunean . | |
| 3,083,431 | 4/1963 | Lewis . | |
| 3,785,740 | 1/1974 | Strong . | |
| 3,791,059 | 2/1974 | Shneider . | |
| 4,019,823 | 4/1977 | Kleinert et al. . | |
| 4,277,434 | 7/1981 | Conway . | |
| 4,500,223 | 2/1985 | Downing et al. . | |
| 4,518,275 | 5/1985 | Rauch, III et al. | 402/80 P |
| 4,603,995 | 8/1986 | Vilona | 402/80 R X |
| 4,607,970 | 8/1986 | Heusinkueld . | |
| 4,886,390 | 12/1989 | Silence et al. | 402/80 R |
| 4,925,328 | 5/1990 | Jeffries . | |
| 4,932,804 | 6/1990 | Richards . | |
| 5,160,208 | 11/1992 | Lockhart . | |
| 5,173,999 | 12/1992 | Welk et al. . | |
| 5,213,429 | 5/1993 | Johnson | 402/8 |
| 5,267,804 | 12/1993 | Baumgarten | 402/80 L X |

FOREIGN PATENT DOCUMENTS

| | | | |
|---|---|---|---|
| 1003154 | 3/1952 | France | 402/80 R |
| 75010 | 5/1894 | Germany | 402/80 L |
| 135604 | 11/1919 | United Kingdom | 402/70 |
| 1156906 | 7/1969 | United Kingdom | 402/74 |

*Primary Examiner*—Frances Han
*Attorney, Agent, or Firm*—John J. Posta, Jr.

[57] ABSTRACT

The improved notebook and notebook cover assembly of the present invention includes a notebook, preferably of a loose-leaf type, and a sub-assembly which includes front and rear notebook covers, an edge binder interconnecting the two covers and foldable back upon itself, and a notebook connector releasably interconnecting the notebook only to the covers. Due to the edge binder the covers are movable between a first position wherein the front cover overlies and protects the notebook and a second position wherein the front cover is behind and flat against the rear cover, thus fully exposing the notebook and supporting it in a flat position for easy viewing and writing therein. The edge binder can have a longitudinal fold line along the length of the center line of the central portion thereof, or can be divided along that center line into two halves joined together by a hinge, such as a piano hinge or a flexible strip of plastic, cloth, paper or rubber. Openable rings or the like releasably secure the notebook to the covers, either directly thereto or to wings connected to the inner surfaces of the covers. If desired, the edge binder can be integral with the covers. Detents may be present on the covers to releasably hold them together when the front cover is in the second position.

15 Claims, 3 Drawing Sheets

FIG. 1
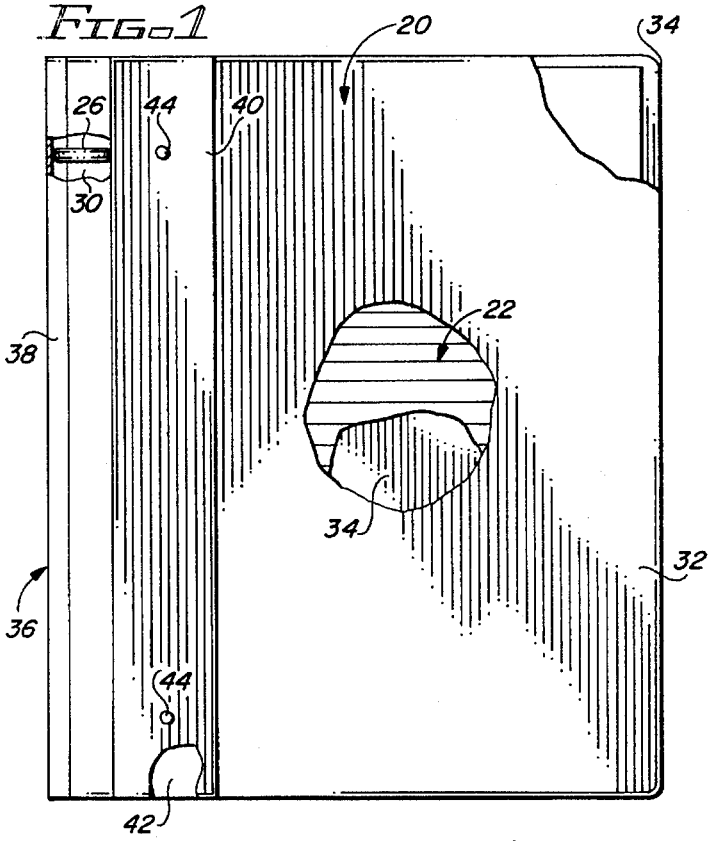
FIG. 2
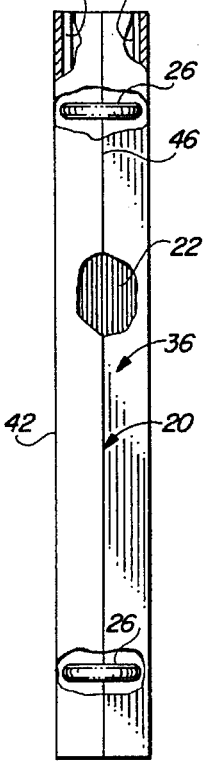
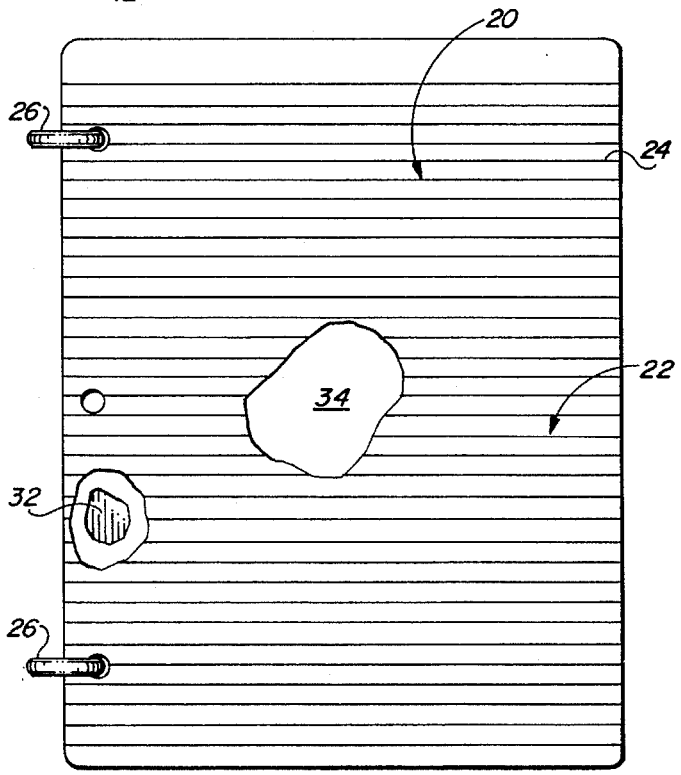
FIG. 4
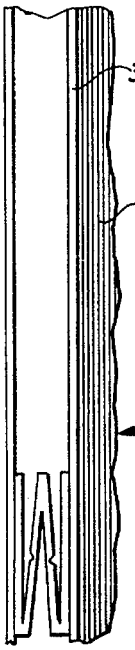
FIG. 5

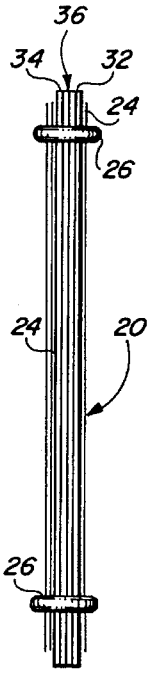
FIG. 3
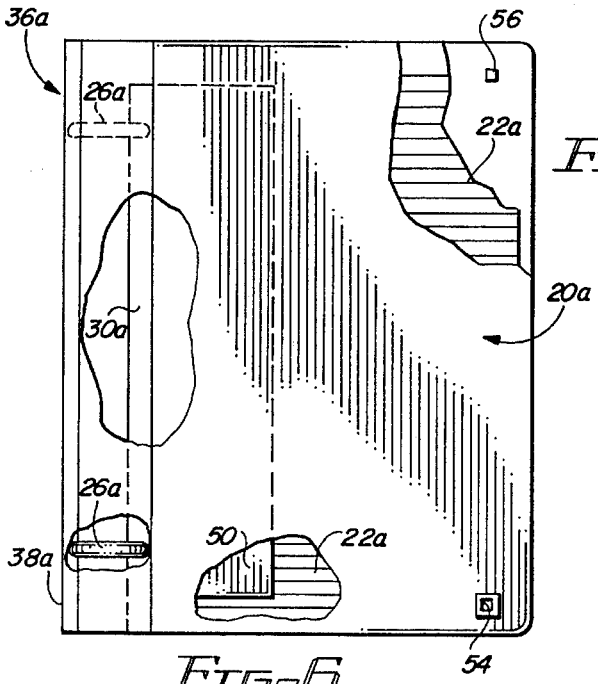
FIG. 6
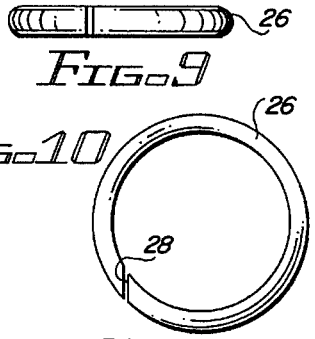
FIG. 9
FIG. 10
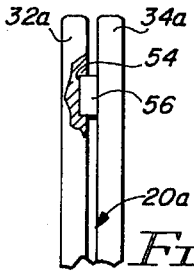
FIG. 11
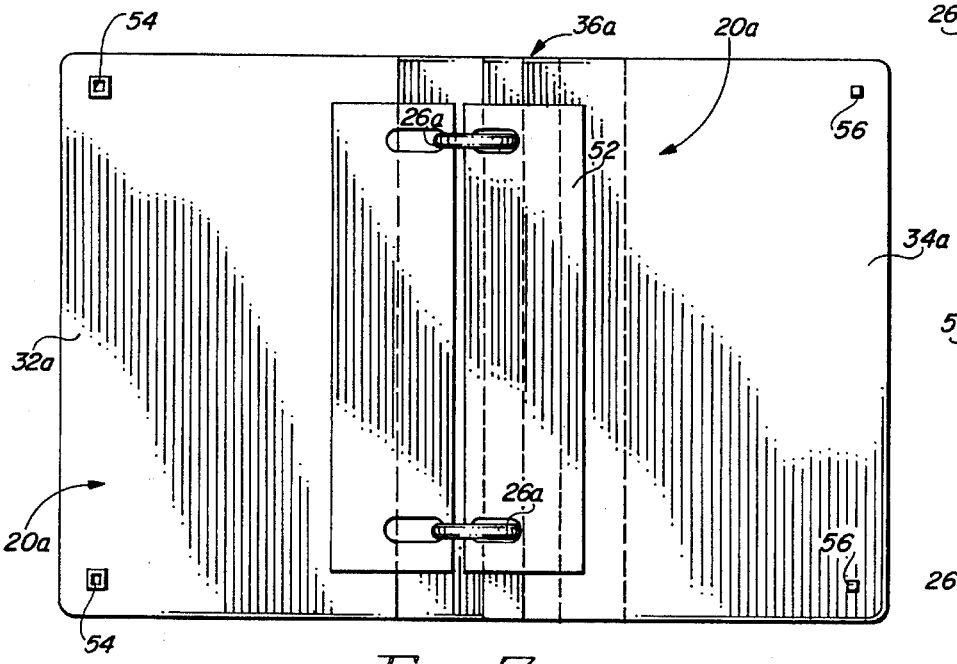
FIG. 7
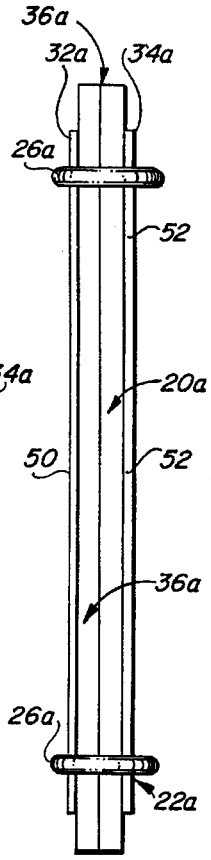
FIG. 8

NOTEBOOK AND NOTEBOOK COVER ASSEMBLY

BACKGROUND OF THE INVENTION

1. Field of the Invention

The present invention generally relates to information storage means and more particularly to an improved assembly which includes a notebook and covers for the same.

2. Prior Art

The usual types of devices for looseleaf notebooks and the like employ front and back covers connected at a spine and adapted to be moved between a front cover-closed position and a front cover-open position, the latter being a position wherein the front cover is fanned apart from the back cover. In the latter position, the front cover extends its full width away from a notebook disposed within the covers. This makes it difficult for the assembly to be balanced on a narrow podium, desk or the like. Moreover, the front cover in either position does not help to support the notebook for writing and reading purposes.

Such devices also usually employ spaced openable rings or the like which are either connected to spines or separated therefrom, but in each instance helping to hold the notebook within the covers. See, for example, U.S. Pat. No. 4,019,823 to Kleinert.

Certain of such devices employ rings which protrude through openings from the covers and/or spines and which are unsightly in appearance. The openings permit the ingress of dirt, moisture and dust to the interior of the device, so that the notebook within the device is not fully protected. See, for example, the devices set forth in U.S. Pat. Nos. 2,409,426 to Feldmann and 4,925,328 to Jeffries.

There presently is a need for an inexpensive notebook and notebook cover assembly which fully protects the notebook from dirt, grime, moisture and soiling and which permits the front cover, when opened, to support the notebook therein for easier writing and viewing. Preferably, such device should be designed so that when the covers are fully opened, the assembly should be no wider than when the covers are closed. This would enable the assembly to be easily balanced on a narrow desk, podium or the like. Moreover, the front cover should be capable of being reflected far enough backwards to aid in supporting the notebook.

SUMMARY OF THE INVENTION

The improved assembly of the present invention satisfies all the foregoing needs. The assembly is substantially as set forth in the ABSTRACT OF THE DISCLOSURE. Thus, the assembly comprises a notebook, preferably of the loose-leaf type, an edge binder interconnecting front and back covers and notebook connector means fully concealed within the edge binder and covers, releasably holding the notebook therein and connected only to the cover and not the edge binder.

The edge binder is capable of being fully folded back on itself and the front cover is movable between a closed protective position and an open exposed position, the latter position has the front cover behind and abutting the back cover, aiding in supporting the notebook for easier reading and writing. In such latter position, the assembly is no wider than when the front cover is in the closed position, so that the assembly easily fits on a narrow desk or the like.

The edge binder or spine either has a longitudinal fold line along the length of the centerline thereof or is divided at that centerline into two equal portions which are joined together by one or more hinges or flexible strips so that the desired folding of the edge binder can easily take place. If desired, the edge binder can be integral with the covers. In such instance, the covers are provided with internal flaps through which the ring connectors are affixed. When the edge binder overlaps the covers, the ring connectors are affixed to the covers in the overlap areas. With such arrangements, the rings remain fully concealed and are not connected to the edge binder directly but only to the covers, so that the edge binder is free to fold upon itself.

The design of the improved binder also encompasses the inclusion of a strap member to allow opening of the notebook and positioning and maintaining it in a teepee fashion to allow reading the notebook without holding it up from a desk, thereby freeing the hands.

The improved assembly can be made easily, rapidly and inexpensively and is durable and efficient. Further features thereof are set forth in the following detained description and accompanying drawings.

DRAWINGS

FIG. 1 is a schematic front elevation, partly broken away, of a first preferred embodiment of the improved notebook and cover assembly of the present invention, shown with the covers thereof in the closed position;

FIG. 2 is a schematic side elevation, partly broken away, of the assembly of FIG. 1, shown with the covers thereof in the closed position;

FIG. 3 is a schematic side elevation of the assembly of FIG. 2, shown with the covers thereof in the open, fully folded back position;

FIG. 4 is a schematic front elevation, partly broken away, of the assembly of FIG. 1, shown in the fully open position with the front cover thereof fully folded back behind the back cover thereof;

FIG. 5 is an enlarged, fragmentary schematic top plan view of the assembly of FIG. 1, shown in the fully open position of FIGS. 3 and 4;

FIG. 6 is a schematic front elevation, partly broken away, of a second preferred embodiment of the improved assembly of the present invention, shown with the covers thereof in the closed position;

FIG. 7 is a schematic front elevation, partly broken away, of the assembly of FIG. 6, shown in the partially open position;

FIG. 8 is a schematic side elevation of the assembly of FIG. 6, shown in the open position;

FIG. 9 is an enlarged schematic front elevation of a preferred embodiment of a ring as used in the assembly of FIG. 1;

FIG. 10 is an enlarged schematic top plan view of the ring of FIG. 9;

FIG. 11 is an enlarged fragmentary, schematic side elevation of the snap cover detents used in the asssembly of FIG. 6, shown with the front and rear covers releasably held together by the detents.

Figure 14:
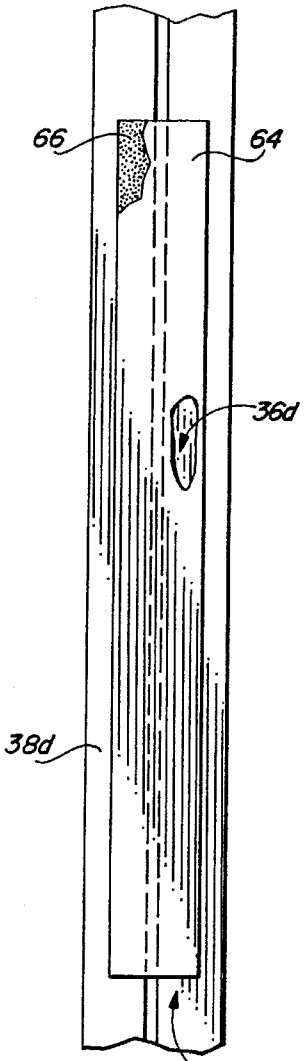
Figure 13:
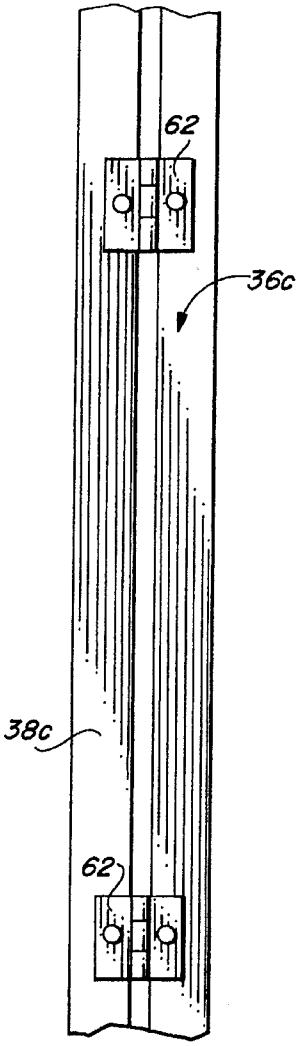

FIG. 13 is an enlarged fragmentary, schematic side elevation of a fourth preferred embodiment of the edge binder of the present invention, shown with two small piano hinges interconnecting the split halves of the edge binder; and, FIG. 14 is an enlarged fragmentary, schematic side elevation, partly broken away, of a fifth preferred embodiment of the edge binder of the present invention, shown with an elongated flexible adhesive strip interconnecting the split halves of the edge binder.

Figure 15:
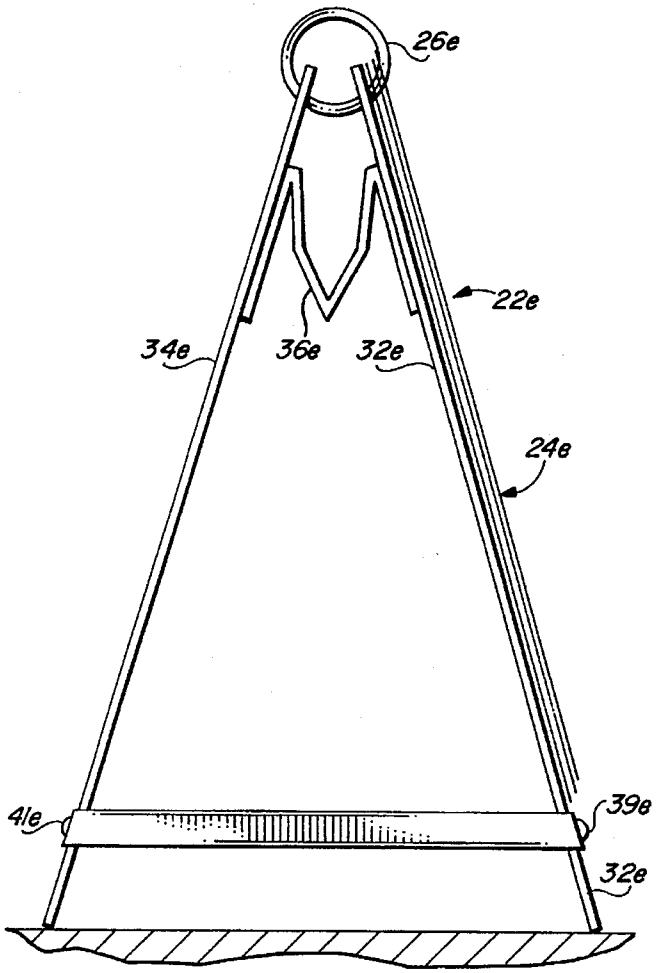

FIG. 15 is a side view of the binder retained in a teepee configuration by a strap.

DETAILED DESCRIPTION

FIGS. 1–5 and 9–10

Now referring more particularly to FIGS. 1–5 and 9–10 of the drawings, a first preferred embodiment of the improved notebook and notebook cover assembly of the present invention is schematically set forth therein.

Thus, assembly 20 is shown, which comprises a loose-leaf notebook 22, the individual leaves 24 thereof being releasably connected to a vertically spaced pair of openable rings 26. Each ring 26 (FIGS. 9–10) can be of resilient plastic or rubber, or the like, and can be provided with a diagonal slit 28 therethrough, so that ring 26 can be easily stretched open but will automatically flex back into the closed position when stretching force thereon is released.

Rings 26 pass through and are releasably connected to the side margins 30 of the front cover 32 and back cover 34 of assembly 10 (FIG. 1). Covers 32 and 34 may be rectangular, square or another shape and in the closed position are positioned in front of (cover 32) and behind (cover 34) notebook 22 (FIGS. 1 and 2).

Covers 32 and 34 are connected to a side edge binder 36 which acts as a spine. Binder 36 has a central portion 38 and wings 40 and 42 connected to the side margins thereof. Wings 40 and 42 extend over, respectively, the front face of cover 32 and rear face of cover 34 and are connected thereto, as by rivets 44. Binder 36 is not connected to rings 26. Binder 36 has a longitudinal fold line 46 running the length of the center line of central portion 38, dividing it into two halves, so that binder 36 can be easily folded back upon itself to the position shown in FIGS. 3 and 5.

In the position shown in FIGS. 3 and 5, notebook 22 is fully exposed, and front cover 32 is positioned directly behind back cover 34 and helps to support notebook 22. In that position, assembly 20 is no wider than when cover 32 is in the closed position of FIGS. 1 and 2, and neatly fits on a narrow desk or podium.

Thus, in the closed position of FIGS. 1 and 2, notebook 22 is fully enclosed and protected against damage, rings 26 are fully enclosed within covers 32 and 34 and binder 36, and there is no opening which permits the invasion of dirt, etc., into assembly 20, as is the case in some conventional assemblies where slits are provided through which binder rings protrude. In the closed position assembly 20 is neat and attractive.

Covers 32 and 34 and edge binder 36 can be fabricated of any suitable materials, such as cloth, plastic, rubber, paperboard or the like in any suitable size and shape. Assembly 20 is inexpensive, durable and efficient.

FIGS. 6–8 and 11

A second preferred embodiment of the improved assembly of the present invention is schematically depicted in FIGS. 6–8 and 11. Thus, assembly **20*a* is shown. Components thereof similar to those of assembly 20** bear the same numerals but are succeeded by the letter "a".

Assembly **20*a* differs from assembly 20** only as follows:

a) Covers **32*a* and 34*a* are integral with edge binder 36*a*;**

b) Flaps 50 and 52 are rectangular sheets of plastic, paperboard, rubber, cloth or the like secured to the inner surfaces of covers **32*a* and 34*a*, extending from the side margins 30*a* thereof, to which rings 26*a* are connected; and, c) Cover 32*a* bears a plurality of spaced recesses 54 in the front face thereof, while cover 34*a* bears a matching plurality of spaced studs 56 in the rear surface thereof with which to releasably lock cover 32*a* against cover 34*a*, as shown in FIG. 11, when cover 32*a* is fully reflected back behind cover 34*a***.

Assembly **20*a* has all the remaining advantages of assembly 20**.

Figure 12:
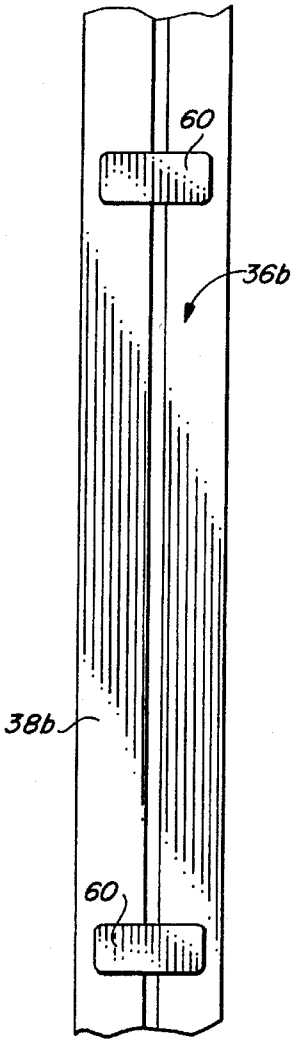
FIG. 12 is an enlarged, fragmentary, schematic side elevation of a third preferred embodiment of the edge binder used in the assembly of the present invention, shown with two small flexible strip connectors interconnecting the split halves of the central portion of the edge binder.

FIGS. 12, 13 and 14

Now referring to FIGS. 12, 13 and 14, third, fourth and fifth preferred embodiments of the edge binder of the present invention are schematically set forth therein. Thus, binders **36*b*, 36*c*, and 36*d*, respectively, are shown in FIGS. 12, 13 and 14. Binders 36*b*, 36*c* and 36*d* are all split into two halves along the vertical center line in central portions 38*b*, 39*c* and 38*d* thereof, and those two halves are rejoined by flexible connectors. In the case of portion 38*b*, a vertically spaced pair of flexible strips 60 are connected to the two halves (FIG. 12). In the case of portion 38*c*, a vertically spaced pair of piano hinges 62 span the two halves thereof, while in the case of portion 38*d*, a single longitudinal flexible strip 64 bearing an adhesive layer 66 on the inner surface thereof is connected through layer 66 and spans the two halves. In each instance, the edge binder is fully foldable back upon itself. Edge binders 36*b*, 36*c* and 36*d* can be substituted for edge binders 36 and 36*a***, if desired.

FIG. 15

This figure discloses a notebook **22*e* with rings 26*e* releasably retaining individual leaves 24*e* and attached to front cover 32*e* and back cover 34*e*. Edge binder 36*e* connects covers 32*e* and 34*e*. A strap 37*e* is connected to front and back covers 32*e* and 34*e* by snaps 39*e* and 41*e*, or other suitable fastening means. When the notebook 22*e* is opened and covers 32*e* and 34*e* are partially folded over, the loose strap is secured to each cover to hold it in the teepee position, so one can read the leaves 24*e* without holding the notebook 22*e***.

Various other modifications, changes, alterations and additions can be made in the improved assembly of the present invention, its components and parameters. All such modifications changes, alterations and additions as are within the scope of the appended claims form part of the present invention.

What is claimed is:

1. An improved notebook and notebook cover assembly, said assembly comprising, in combination:

a) a notebook;

b) separate front and back notebook covers with said notebook disposed therebetween;

c) a notebook edge binder foldable upon itself and interconnecting said front and back covers to form a subassembly for movement of said covers between a first position wherein said front cover is spaced from and overlies said back cover to protect said notebook disposed between said covers, and a second position wherein said front cover is reflected behind said back cover and lies flat therewith to fully expose said notebook in a flat open position for easy reading; and, d) notebook connector means releasably secured only to said notebook and to said covers and not to said edge binder, and fully covered by said sub-assembly, said connector means permitting said movement of said covers between said first and second position, said edge binder being secured by securing means to the outside of said front and back covers, except in the areas of connection of said covers and said notebook connector means, said edge binder having a central portion with a longitudinal fold line disposed along the length thereof to permit said folding of said edge binder back over itself.

2. The improved assembly of claim 1 wherein said notebook connector means comprises a plurality of openable rings releasably interconnecting said notebook and said front and back covers, the points of connection of said rings and covers being in an area covered by said edge binder.

3. The improved assembly of claim 1 wherein said front and back covers bear detent means for releasably securing said front and back covers together when said front cover is in said second position.

4. The assembly of claim 1 wherein said front and back covers include fastening means for retaining said notebook in a partial open, teepee configuration.

5. The improved assembly of claim 1 wherein said central portion of said edge binder is divided into halves along the length of the center line thereof and wherein flexible foldable hinge means are connected to said halves of said edge binder to permit easy folding of said edge binder back over itself.

6. The improved assembly of claim 5 wherein said hinge means comprises at least one piano hinge bridging said halves of said central portion of said edge binder.

7. The improved assembly of claim 5 wherein said hinge means comprises a flexible strip.

8. The improved assembly of claim 7 wherein said flexible strip comprises one of flexible cloth, plastic, paper and rubber.

9. An improved notebook and notebook cover assembly, said assembly comprising, in combination:

a) a notebook;

b) separate front and back notebook covers with said notebook disposed therebetween;

c) a notebook edge binder foldable upon itself and integral with said front and back covers to form a sub-assembly for movement of said covers between a first position wherein said front cover is spaced from and overlies said back cover to protect said notebook disposed between said covers, and a second position wherein said front cover is reflected behind said back cover and lies flat therewith to fully expose said notebook in a flat open position for easy reading, said edge binder having a longitudinal fold line along the length thereof permitting said edge binder to be readily folded back upon itself; and, d) notebook connector means releasably secured only to said notebook and to said covers and not to said edge binder, and fully covered by said sub-assembly, said connector means permitting said movement of said covers between said first and second positions.

10. The improved assembly of claim 9 wherein flaps are connected to the inner surfaces of said front and back covers adjacent the edges thereof, adjacent said edge binder, and extend rearwardly of said cover edges, and wherein said hinge means comprises openable rings releasably interconnect said notebook and said covers through said flaps.

11. The assembly of claim 10 wherein said flaps have portions sufficiently large to overlap the entire front and back covers.

12. The improved assembly of claim 9 wherein said edge binder has a central portion divided into halves and wherein hinge means interconnect said halves for easy folding of said edge binder.

13. The improved assembly of claim 12 wherein said hinge means comprises a piano hinge bridging said halves of said central portion of said edge binder.

14. The improved assembly of claim 12 wherein said hinge means comprise a flexible strip.

15. The improved assembly of claim 14 wherein said strip comprises one of plastic, cloth, paper and rubber.

* * * * *